US005505369A

United States Patent [19]

Taliaferro

[11] Patent Number: 5,505,369

[45] Date of Patent: Apr. 9, 1996

[54] KNOCKED-DOWN FLAT PREFORM FOR A SHIPPING AND DISPLAY CONTAINER

[75] Inventor: Diale Taliaferro, Battle Creek, Mich.

[73] Assignee: Kellogg Company, Battle Creek, Mich.

[21] Appl. No.: 213,486

[22] Filed: Mar. 15, 1994

[51] Int. Cl.[6] ..... B65D 5/462; B65D 5/68

[52] U.S. Cl. ..... 229/117.16; 229/23 BT; 229/125.19; 229/125.32

[58] Field of Search ..... 229/23 R, 23 BT, 229/117.16, 125.19, 125.32

[56] References Cited

U.S. PATENT DOCUMENTS

| | | | |
|---|---|---|---|
| 2,074,229 | 3/1937 | McKee | 229/23 R |
| 2,540,595 | 2/1951 | Props | 229/125.19 |
| 3,063,615 | 11/1962 | Bronte et al. | 229/23 R |
| 3,157,345 | 11/1964 | George | 229/23 BT |
| 3,285,492 | 11/1966 | Demby et al. | 229/23 R |
| 3,374,603 | 3/1968 | Miller et al. . | |
| 3,640,190 | 2/1972 | Fuller et al. . | |
| 3,774,705 | 7/1973 | Kuhn et al. | 229/117.16 |
| 3,817,018 | 6/1974 | Vickers . | |
| 3,956,874 | 5/1976 | Vickers et al. . | |
| 3,986,319 | 10/1976 | Puskarz et al. . | |
| 4,396,144 | 8/1983 | Gutierrez et al. | 229/23 BT |
| 4,642,967 | 2/1987 | Culpepper . | |
| 4,674,261 | 6/1987 | Sabel . | |
| 4,848,651 | 7/1989 | Hartness . | |
| 4,852,796 | 8/1989 | Katzman . | |
| 4,869,424 | 9/1989 | Wood . | |
| 4,946,093 | 8/1990 | Moorman . | |
| 5,016,753 | 5/1991 | Henderson | 229/23 BT |
| 5,076,491 | 12/1991 | Freudentahl et al. | 229/23 R |
| 5,105,950 | 4/1992 | Gottfried et al. . | |
| 5,121,877 | 6/1992 | Bodary et al. . | |

FOREIGN PATENT DOCUMENTS

| | | | |
|---|---|---|---|
| 109841 | 4/1990 | Japan | 229/125.19 |

*Primary Examiner*—Gary E. Elkins
*Attorney, Agent, or Firm*—Felfe & Lynch

[57] ABSTRACT

Unitary preform includes a knocked-down flat shroud having sidewalls received inside a knocked-down flat tray and adhered thereto for handling by a conventional case packer having a single magazine. The shroud is releasable when the case is packed to provide a display tray for product packed therein. Handles in the tray provide means for releasing adhesive. Alternatively, the tray may be received inside the shroud. Methods of manufacture include steps of folding and adhering separately formed flat parts.

4 Claims, 6 Drawing Sheets

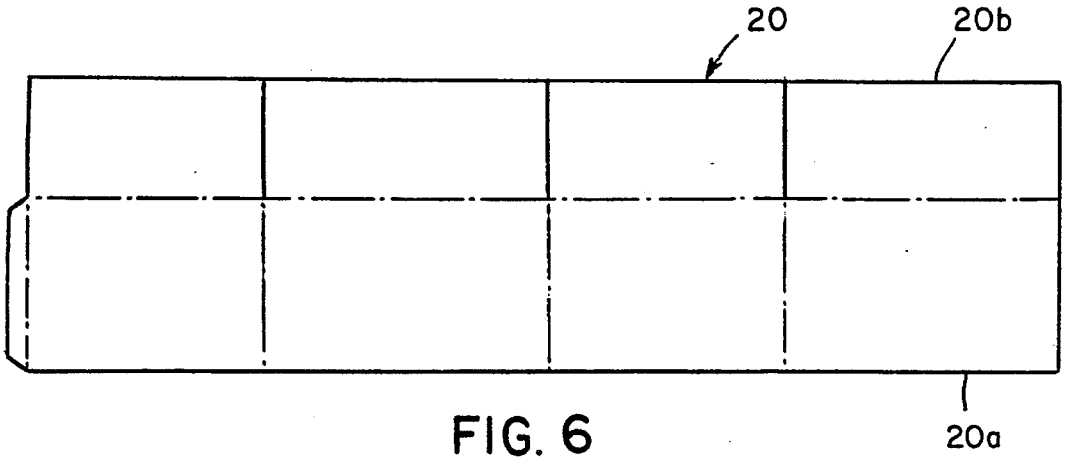
FIG. 6
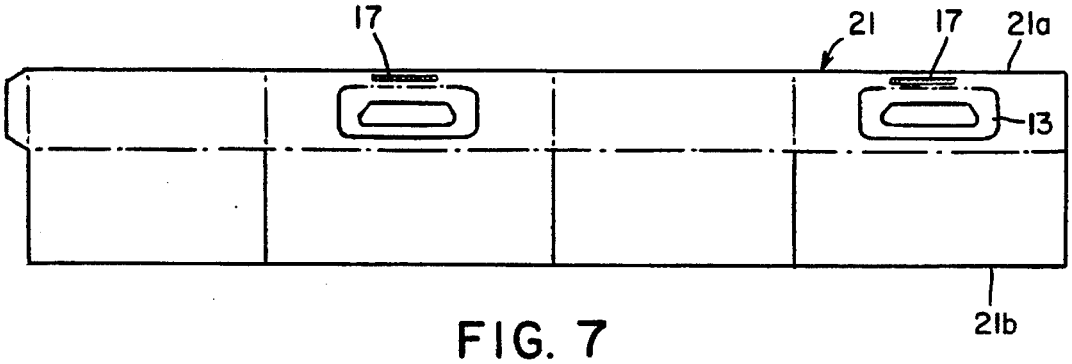
FIG. 7
FIG. 8
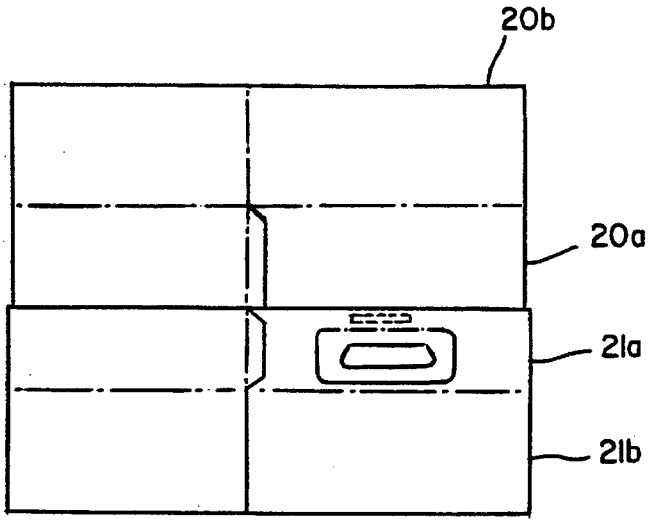

KNOCKED-DOWN FLAT PREFORM FOR A SHIPPING AND DISPLAY CONTAINER

BACKGROUND OF THE INVENTION

This invention relates to a knocked-down flat preform for a regular slotted shipping and display container having a tray and shroud. A regular slotted container is a universal case or box. Functionally, the container is a two-part case in which one part is a shroud and one part is a tray and the shroud is separable from the tray which serves as a displayable case. The invention also relates to an improvement in the container relating to a handle portion for detaching the tray from the shroud.

The invention relates to a method of making a shipping and display container comprising multiple parts assembled in such a manner as to provide a display tray as part of the container which can be packed on conventional regular slotted container (RSC) case packers. This eliminates the need for special case packing equipment such as tray formers, tray makers and lidders to produce a displayable container. Also, only one knocked-down flat (KDF) magazine may be utilized associated with the method of the present invention.

U.S. Pat. No. 4,848,651 relates to a displayable container having a removable lid. To remove the lid, a user inserts his fingers between adjacent panels of the cap cover and base member and quickly extends his hands outwardly to break the adhesive binding, thereby releasing the cover for removal.

U.S. Pat. No. 5,016,753 relates to a telescoping container structure which comprises a plurality of pieces which may be temporarily secured to one another and shipped in a flat form and to a method of manufacturing the same. When assembled, the pieces of the container telescope relative to one another and may be secured to one another at any position to create a container of infinitely variable volume.

U.S. Pat. No. 5,105,950 relates to a container having a cardboard carton lid constructed so that the carton may be packed and shipped without the necessity for plastic wrapping and yet allow the carton lid to be reused. The lid has elongated side panels with first and second parallel lines of weakness (e.g., perforations) formed in them. The bottom fastening portion of the side panels is secured, as by adhesive, to the carton body sidewalls. A blank and enlarged grasping portion in the carton lid side panels at the lines of weakness allow a user to grasp a strip between the lines of weakness and detach the securing portions of the side panels. The lid can be reused after detachment. The carton is packed with non-deformable material, such as business forms, which extend above the top edge of the carton. After the lid is compressed, to reduce voids in the material, the components are maintained in the compressed condition, and the side panels are glued to the carton body sidewalls, without interfering with the ability of the lid to flex at the lines of weakness. The lid will flex at the lines of weakness during use.

It is an object of the invention, therefore, to provide a new and improved method of making a regular slotted shipping and display container having a tray and a shroud which avoids one or more of the limitations and disadvantages of such prior methods.

It is another object of the invention to provide a new and improved method of making a knocked-down flat preform for a regular slotted shipping and display container having a tray and a shroud, which preform is adapted for use with a conventional regular slotted container case packer.

It is another object of the invention to provide in a preform for a shipping and display container for a boxed product having a tray and shroud, the tray being adhered to the shroud, a new and improved handle structure for detaching the tray from the shroud.

SUMMARY OF THE INVENTION

In accordance with the invention, a unitary knocked-down flat prefrom for a regular slotted shipping and display container having a tray releasably adhered to a shroud comprises a knocked-down flat shroud and a knocked-down flat tray around the shroud with substantially the entire side walls of the tray partially overlapping the side walls of the shroud the side walls of the KDF tray being adhered to the side walls of the KDF shroud.

Also in accordance with the invention, a method of making a knocked-down flat preform for a regular slotted shipping and display container having a tray releasably adhered to a shroud comprises forming a flat tray blank having side walls and bottom flaps and a flat shroud blank having side walls and top flaps. The method includes positioning substantially the entire side walls of the tray blank over the side walls of the shroud blank and adhering the flat tray blank to the flat shroud blank, then folding the blanks to form a knocked-down flat preform regular slotted container.

Also in accordance with the invention, in a preform for a shipping and display container for a product having a tray and shroud, the tray being adhered to the shroud, the improvement comprises the tray having a side portion having a handle portion cut therein, a portion of the tray being releasably adhered to the shroud and the handle portion being adapted to be grasped and rotated outwardly for detaching the tray from the shroud.

Also in accordance with the invention, a method of making a knocked-down flat preform for a regular slotted shipping and display container having a shroud releasably adhered to a tray comprises (a) forming a blank having side walls and bottom flaps into a knocked-down flat tray. The method also comprises (b) forming a blank having side walls and top flaps into a knocked-down flat shroud around the KDF tray with the side walls of the KFD shroud overlapping substantially the entire side walls of the KDF tray and adhering side walls of the KDF shroud to side walls of the KDF tray.

Also in accordance with the invention, a method of making a two-part knocked-down flat regular slotted shipping and display container having a tray releasably adhered to a shroud comprises forming a flat tray blank having side walls and bottom flaps and a flat shroud blank having side walls and top flaps. The method also comprises positioning the side walls of the shroud blank over substantially the entire side walls of the tray blank and adhering the flat shroud blank to the flat tray blank to form the adhered flat shroud blank and the flat tray blank into a knocked-down flat preform for a regular slotted container.

Also in accordance with the invention, in a shipping and display container for a boxed product having a tray and shroud, the tray being adhered to the shroud, the improvement comprises the shroud having a side having a handle portion cut therein, a portion of the tray being releasably adhered to the shroud and the handle portion being adapted to be grasped and rotated outwardly for detaching the shroud from the tray.

For a better understanding of the present invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings:

FIG. 6 is a plan view of a shroud blank utilized to form the FIG. 1 container;

FIG. 7 is a plan view of a tray blank utilized to form the FIG. 1 container;

FIG. 8 is a plan view of a knocked-down flat shroud and knocked-down flat tray when folded as a preform for a conventional regular slotted container (RSC) case packer;

DESCRIPTION OF PREFERRED EMBODIMENTS

Figure 1:
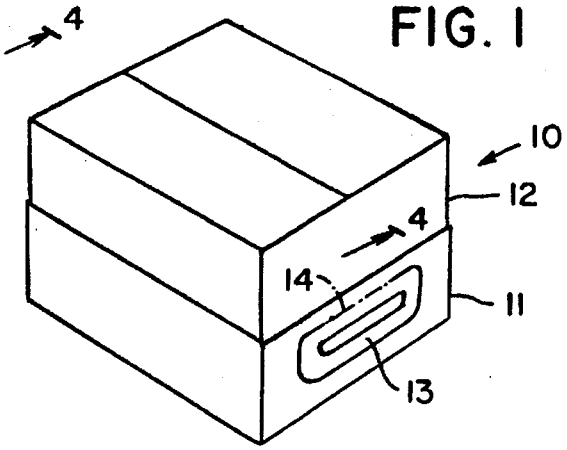
FIG. 1 is a perspective view of a regular slotted shipping and display container in condition for shipping.
Figure 2:
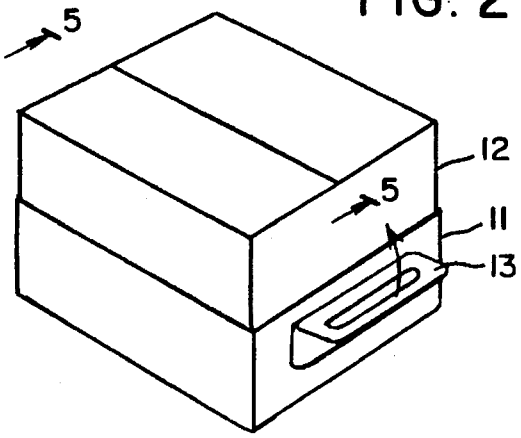
FIG. 2 is a perspective view of the FIG. 1 container with handle portions outwardly rotated and raised.

Referring now more particularly to FIG. 1 of the drawings, there is represented a shipping and display container 10 having a tray 11 and a shroud 12. The tray 11 is adhered to the shroud as will be more fully explained subsequently and the tray has a side having a handle portion 13 cut therein. The handle portion 13 is preferably die cut and preferably has a score line of demarcation, for example, scored along an upper edge thereof 14. The tray is adhered to the shroud near the handle which is adapted to be grasped and rotated outwardly, as represented in FIG. 2, for detaching the tray 11 from the shroud 12. Alternatively, the handle portion may be perforated in lieu of being scored so that the handle may be torn away from the tray 11 after the tray 11 is detached from the shroud. Also, instead of being perforated, a zipper strip may be included in the handle so that the handle may be detached from the tray 11 after the tray is detached from the shroud.

Figure 3:
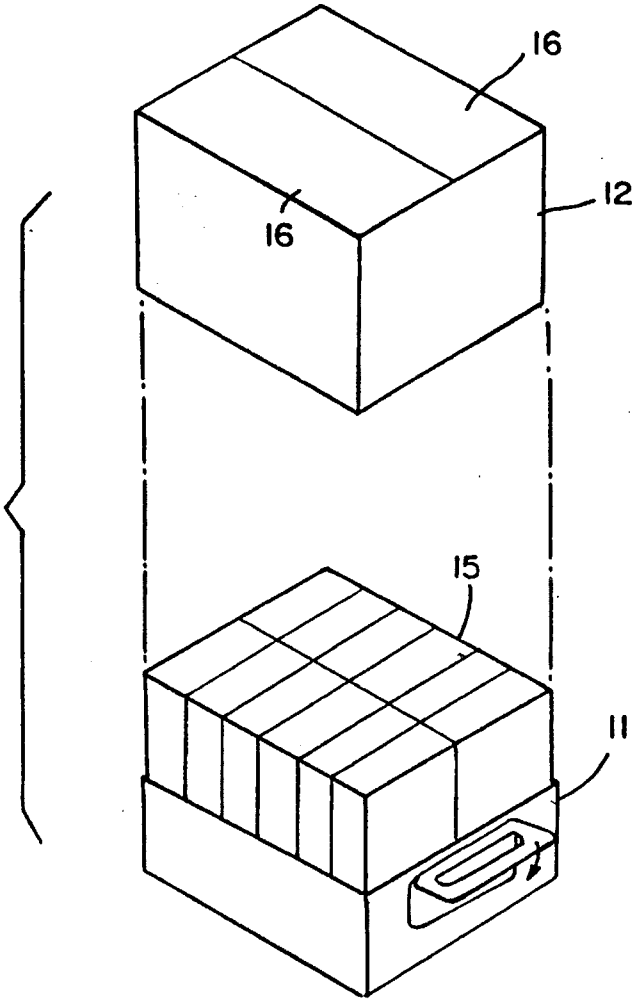
FIG. 3 is an exploded perspective view of the FIG. 2 container showing a boxed product therein.

As represented in FIG. 3, when the tray 11 is detached from the shroud 12, the shroud 12 can be removed from the tray and the tray then serves as a display container for a boxed product 15. The shroud 12 has two top flaps 16 thereon.

Figure 4:
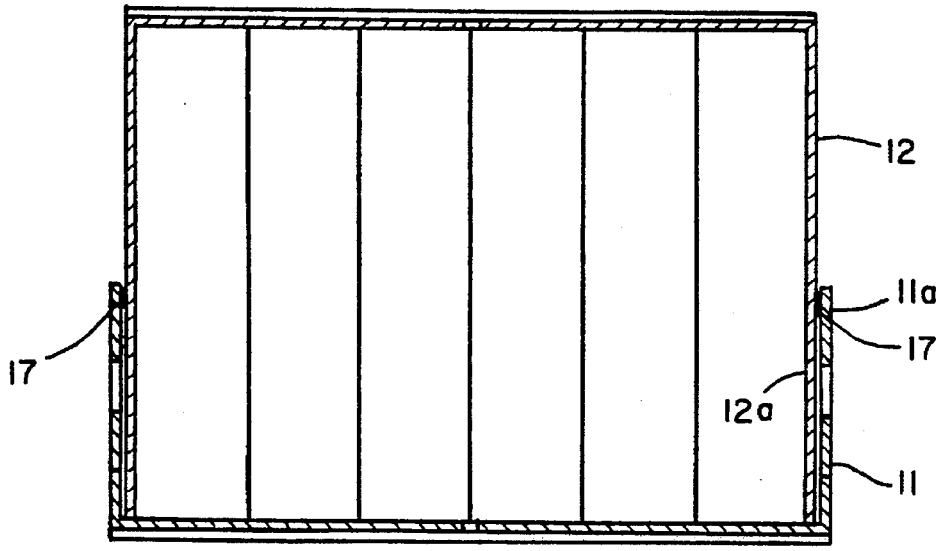
FIG. 4 is a sectional elevational view of the FIG. 1 container, taken along line 4—4 of FIG. 1.
Figure 5:
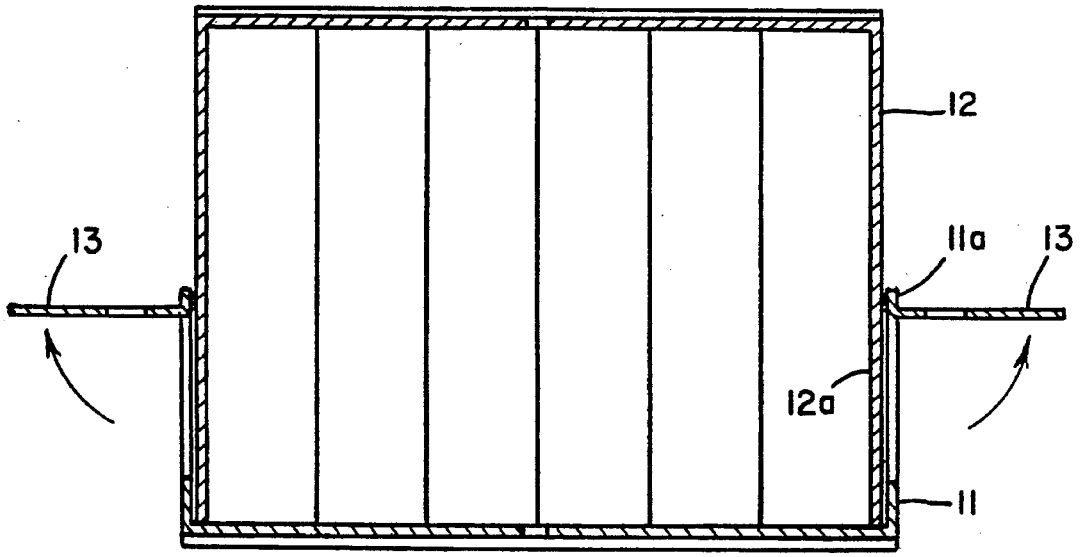
FIG. 5 is a sectional view of the FIG. 2 container, taken along line 5—5 of FIG. 2.

Referring now more particularly to FIGS. 4 and 5, FIG. 4 is a cross-sectional elevation view of the FIG. 1 container representing the shroud 12 extending to the bottom of the tray 11 inside the tray 11. The shroud 12 is adhered to the tray 11 by adhesive strips 17 which may be hot melt or "cold glue". A resin adhesive preferably is used. A strip 17 on the inner side of the tray may be seen more clearly to an enlarged scale in FIG. 9, which shows in fragmentary view the handle portion 13 in the tray 11 having disposed therein the shroud 12. The shroud preferably is adhered to the tray on two sides of the tray.

Referring now more particularly to FIG. 5 of the drawing, FIG. 5 is a cross-sectional view of the FIG. 2 container and is similar to the FIG. 4 but with the handle portions 13 rotated outwardly, whereupon the handle portions may be grasped and pulled to detach the tray from the shroud.

As may be seen in FIGS. 4 and 5, a portion 12*a* of the side wall of the shroud is coextensive with the side wall 11*a* of the tray. As will become apparent, the knocked-down flat blanks of the shroud and the tray are positioned such that the side walls of the tray blank overlie a lower portion of the side walls of the shroud blank.

FIG. 6 is a plan view of a shroud blank 20 having a top flap 20*b*. FIG. 7 is a plan view of a tray blank 21 having a side wall 21*a* having thereon, for example, an adhesive strip 17 and a handle portion 13 below the adhesive strip 17. A bottom flap 21*b* is integral with the side wall 21*a*.

Figure 12:
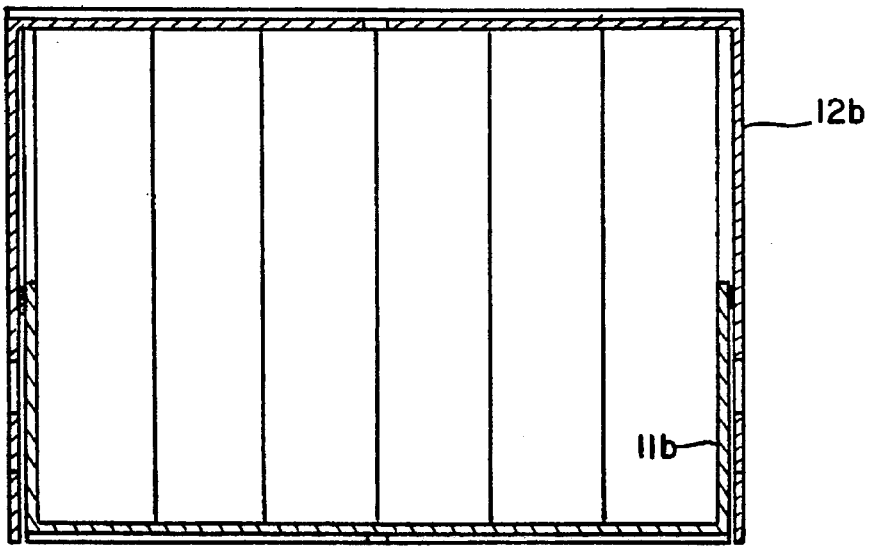
FIG. 12 is a sectional view of a container with a shroud outside a tray and similar to the FIG. 4 view of the FIG. 2 container.
Figure 13:
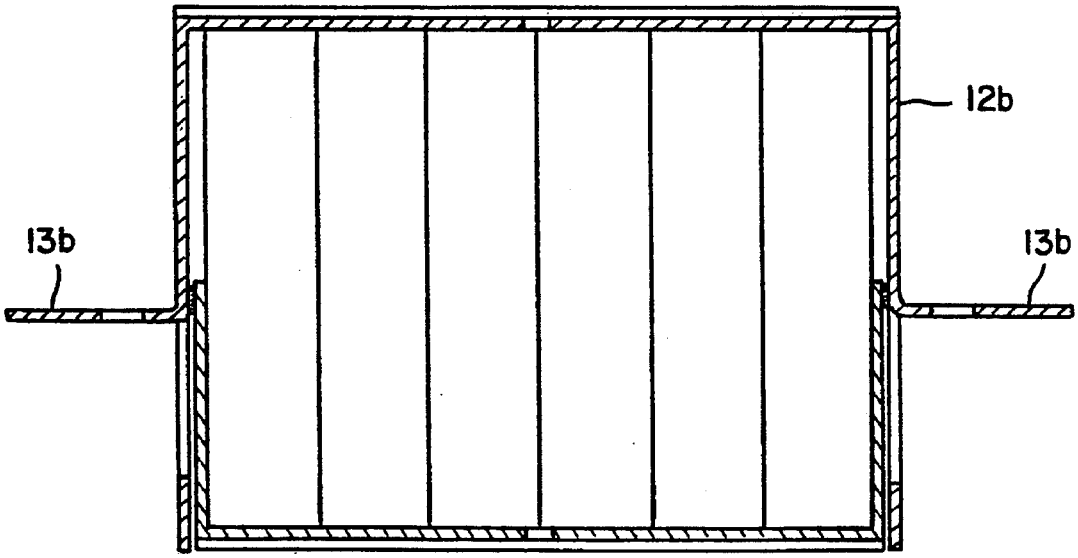
FIG. 13 is a sectional view of the FIG. 12 container and similar to the FIG. 5 view of the FIG. 2 container.

When the tray is to be assembled outside the shroud as will be explained in connection with FIGS. 10 and 11, the adhesive may be applied to the tray or the shroud, whichever is more convenient. As will also be explained subsequently the tray may also be assembled inside the shroud as shown in FIGS. 12 and 13. The adhesive may also be applied to the tray or the shroud, whichever is more convenient, when the tray is to be assembled inside the shroud.

Referring again to FIG. 9, the handle portion 13 is cut around three sides and a score line 18 causing perforations is made across the top portion of the handle so that the handle may be folded after use into the position represented in FIG. 1 or may be detached entirely from the tray. An upper region of the handle portion 13 near the score line 18 is adhered to the shroud. The handle can also be made with no score line or die cut across the top portion of the handle so that the handle will stay intact and may be folded after use into the position represented in FIG. 1.

Figures 9, 10:
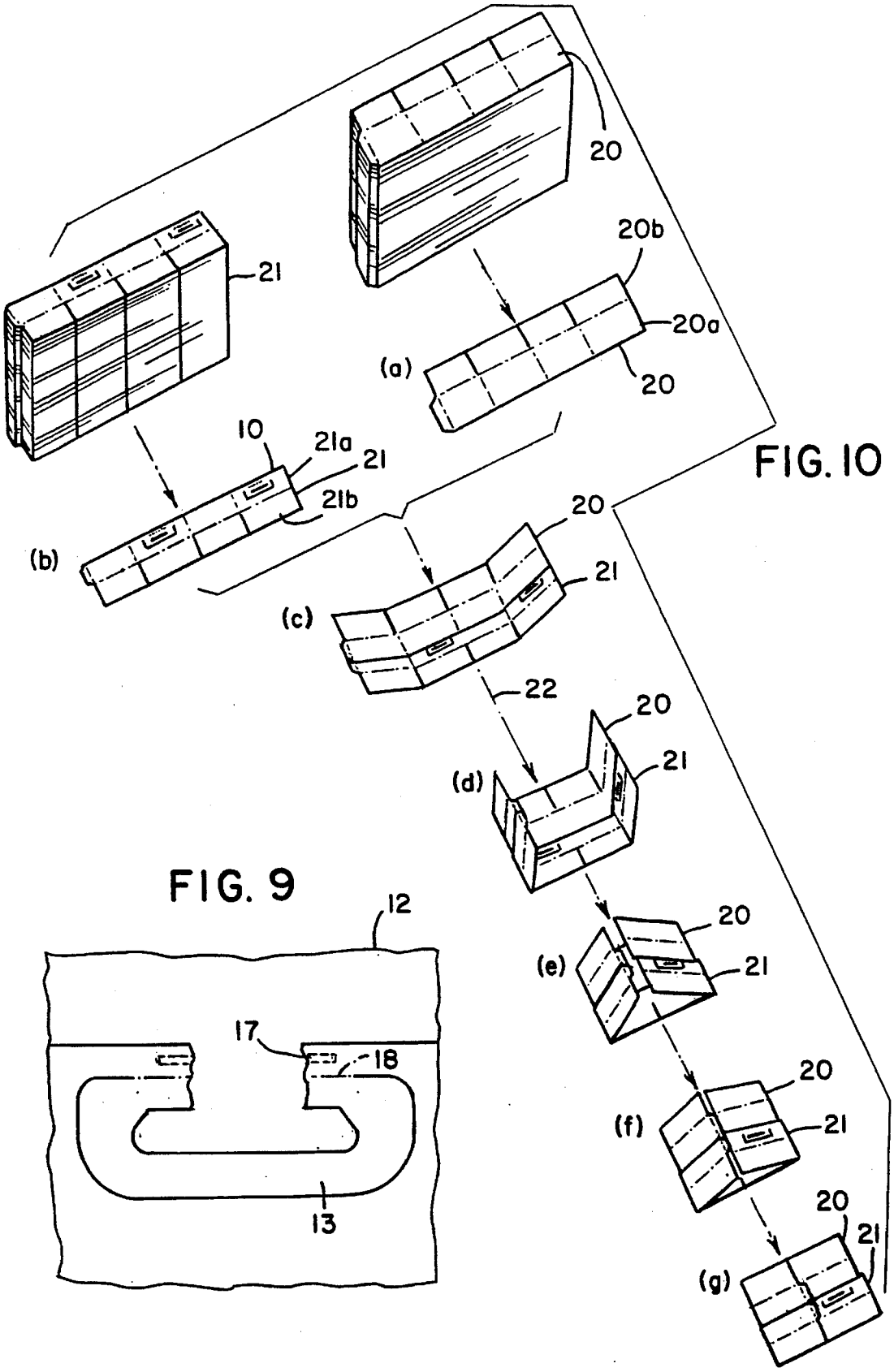
FIG. 9 is a fragmentary plan view, to an enlarged scale, of a handle portion of the FIG. 1 container.
FIG. 10 is a composite exploded perspective view representing the steps in accordance with the invention which may be utilized in the manufacture of each preform.

Referring now more particularly to FIG. 10, in accordance with the invention, a method of making a knocked-down flat preform for regular slotted shipping and display container having a tray and a shroud comprises (a) providing a stack of shroud blanks 20 having side walls 20*a* and top flaps 20*b* and a stack of tray blanks 21 having side walls 21*a* and bottom flaps 21*b* which are (b) utilized individually with the side walls of the tray blank 21 partially overlapping the side walls of the shroud blank 20 and (c) adhering the side walls of the tray to the side walls of the shroud. The method comprises (d–f) folding end portions of the blank 20 of the shroud blanks 20 and 21 toward a centerline 22 until the two-part knocked-down flat preform is reached at view (g).

Figure 11:
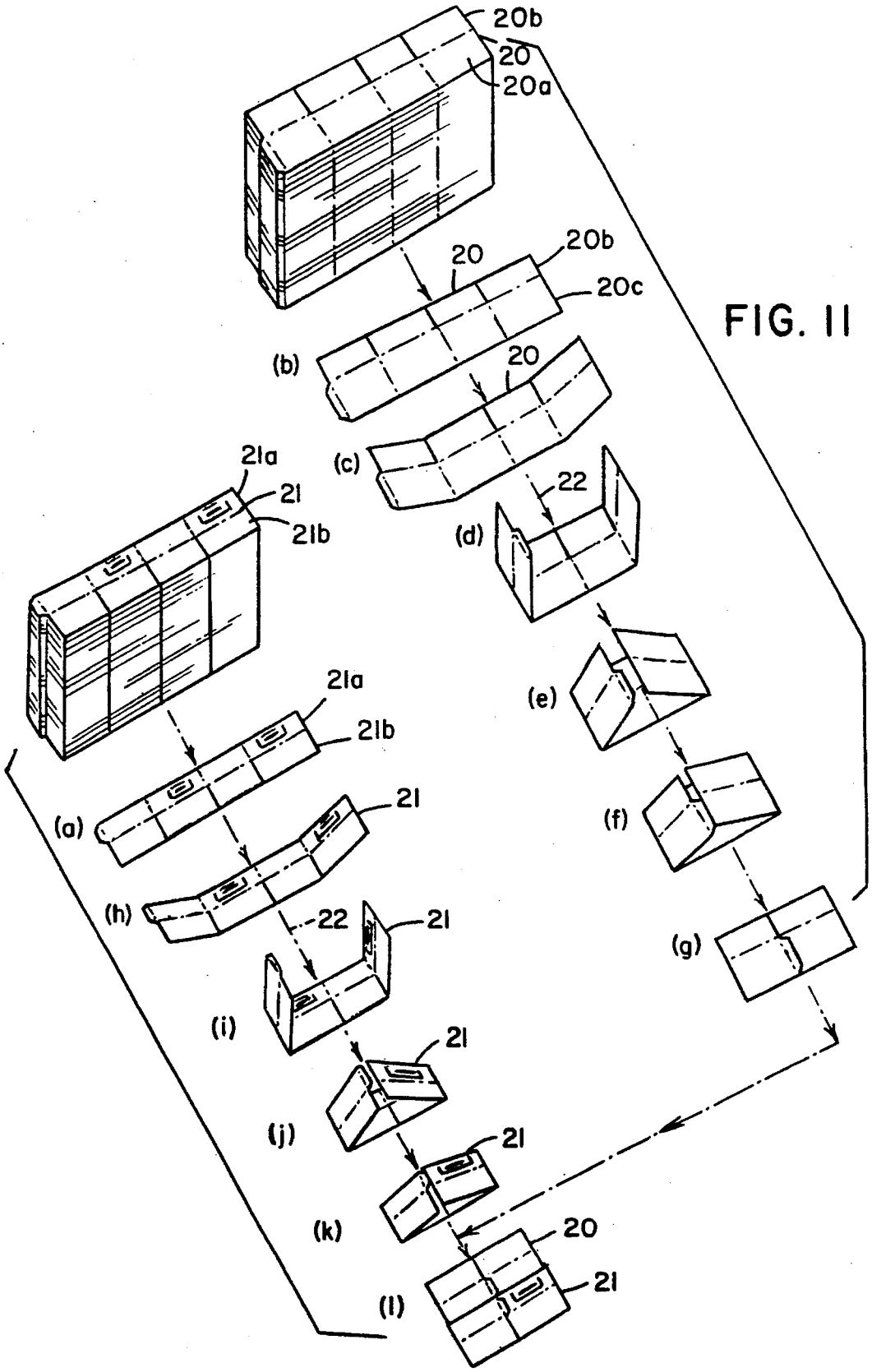
FIG. 11 is a composite exploded perspective view representing alternative steps in accordance with the invention which may be utilized in the manufacture of each preform.

Referring now more particularly to FIG. 11, in accordance with the invention, an alternate method of making a two-part knocked-down flat preform for a regular slotting shipping and display container having a tray and a shroud comprises (a) providing a flat tray blank 21 having side walls 21*a* and bottom flaps 21*b* and a flat shroud blank 20 having side walls 20*a* and two flaps 20*b* (FIGS. 11*a* and 11*b*).

Instead of adhering the shroud blank 20 to the tray blank 21 and then folding the two part assembly as in FIG. 10, the shroud blank 20 and tray blank 21 of FIG. 11 are folded separately. The shroud blank 20 is folded to the knocked-down flat configuration of FIG. 11(*g*) and slipped inside the folded tray configuration of FIG. 11(*k*) prior final folding of the tray blank 21 to form the two-part knocked-down flat preform of FIG. 11(*l*).

FIGS. 12 and 13 relate to another embodiment of the invention in which the shroud 12*b* is disposed over and outside the tray 11*b*. The handles 13*b*, as may be seen in FIG. 13, are attached to the shroud and form part of the shroud in a manner similar to the handles 13 of the tray 11 of FIG. 5.

In another embodiment which may be generally similar to the FIG. 2 embodiment with the tray releasably adhered to the shroud around the outside of the shroud, a tear strip in the tray parallel to the upper edge of the tray may be utilized to releasably adhere the tray to the shroud with an adhesive band between the tray and the shroud only in the region of the tear strip or below the tear strip. The tear strip may, for example, be a zipper-like strip formed by parallel lines of weakness in the tray. The tear strip may be pulled away from the tray and the shroud to release the tray from the shroud to make the shroud removable to form a display container.

Alternatively, in another embodiment generally similar to the FIG. 12 embodiment with shroud releasably adhered to the tray around the outside of the tray, a tear strip in the shroud parallel to the upper edge of the tray may be utilized to releasably adhere the shroud to the tray with an adhesive bond between the shroud and the tray only in the region of the tear strip or below the tear strip. The tear strip may, for example, be a zipper-like strip formed by parallel lines of weakness in the shroud. The tear strip may be pulled away from the shroud and the tray to release the shroud from the tray to make at least the upper portion of the shroud removable to form a display container. A line of perforations may alternatively be used to form a line of weakness in the shroud for removing the shroud from the tray.

While there have been described what are considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Knocked-down flat preform for a two-part shipping and display container, said preform comprising a knocked-down flat shroud having side walls and top flaps, a knocked-down flat tray having side walls and top flaps, said side walls of said knocked-down flat shroud being received inside said side walls of said knocked-down flat tray, said side walls of said knocked-down flat tray being perforated to form handle means which can be folded away from said side walls of said tray, and adhesive attaching said side walls of said knocked-down flat shroud to said side walls of said knocked-down flat tray, thereby forming a unitary knocked-down flat preform for a two-part shipping and display container, said adhesive being so located that it can be released by pulling on said handle means.

2. Knocked-down flat preform for a two-part shipping and display container, said preform comprising a knocked-down flat shroud having side walls and top flaps, a knocked-down flat tray having side walls and bottom flaps, said side walls of said knocked-down flat tray being received inside said side walls of said knocked-down flat shroud, said side walls of said knocked-down flat shroud being perforated to form handle means which can be folded away from said side walls of said shroud, and adhesive attaching said side walls of said knocked-down flat shroud to said side walls of said knocked-down flat tray, thereby forming a unitary knocked-down flat preform for a two-part shipping and display container, said adhesive being so located that it can be released by pulling on said handle means.

3. A shipping and display container comprising a shroud having side walls and a top, a tray having side walls and a bottom, said side walls of said shroud being received inside said side walls of said tray, said side walls of said tray being perforated to form handle means which can be folded away from the side walls of said tray, and adhesive attaching said sidewalls of said shroud to said side walls of said tray, said adhesive being so located that it can be released by pulling on said handle means.

4. A shipping and display container comprising a shroud having side walls and a top, a tray having side walls and a bottom, said side walls of said tray being received inside said side walls of said shroud, said side walls of said shroud being perforated to form handle means which can be folded away from the side walls of the shroud, and adhesive attaching said sidewalls of said shroud to said side walls of said tray, said adhesive being so located that it can be released by pulling on said handle means.

* * * * *